US008904817B2

(12) United States Patent
Kim et al.

(10) Patent No.: US 8,904,817 B2
(45) Date of Patent: Dec. 9, 2014

(54) REFRIGERATOR AND A CONTROL METHOD FOR THE SAME

(75) Inventors: Chang Joon Kim, Seoul (KR); Jun Ho Bae, Seoul (KR); Soo Kwan Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 881 days.

(21) Appl. No.: 12/594,292

(22) PCT Filed: Mar. 28, 2008

(86) PCT No.: PCT/KR2008/001739
§ 371 (c)(1),
(2), (4) Date: Oct. 1, 2009

(87) PCT Pub. No.: WO2008/120905
PCT Pub. Date: Oct. 9, 2008

(65) Prior Publication Data

US 2010/0107678 A1 May 6, 2010

(30) Foreign Application Priority Data

Apr. 3, 2007 (KR) ..... 10-2007-0032849

(51) Int. Cl.
*F25D 17/06* (2006.01)
*F25D 29/00* (2006.01)

(52) U.S. Cl.
CPC ..... *F25D 17/065* (2013.01); *F25D 29/003* (2013.01); *F25D 2317/0651* (2013.01); *F25D 2700/12* (2013.01); *F25D 2700/121* (2013.01)
USPC ..... 62/419

(58) Field of Classification Search
CPC ..... F25D 17/04; F25D 17/08; F25D 25/00; F25D 17/062; F25D 17/065; F25D 17/067; F25D 29/003; F25D 2700/121; F25D 2317/0651; F25G 23/00
USPC ..... 62/126–130, 151, 155–156, 179–180, 62/186, 234, 276, 314, 408, 414, 419, 62/441–442, 446, 450, 525, 66, 81–82, 62/131, 176, 190, 231, 239, 271, 337, 338, 62/431, 447, 515, 526, 528, 187, 417
See application file for complete search history.

(56) References Cited

U.S. PATENT DOCUMENTS 3,004,401 A * 10/1961 Mann et al. ..... 62/156
3,050,956 A * 8/1962 Mann et al. ..... 62/283

(Continued)

FOREIGN PATENT DOCUMENTS

EP 0 828 121 3/1998
EP 1 314 940 5/2003

(Continued)

OTHER PUBLICATIONS

Korean Decision to Grant a Patent dated May 30, 2008.

(Continued)

*Primary Examiner* — Mohammad M Ali
*Assistant Examiner* — Emmanuel Duke
(74) *Attorney, Agent, or Firm* — Ked & Associates, LLP

(57) ABSTRACT

A refrigerator and a control method for the same are provided. A refrigerator includes a body having a cooling compartment and a storage compartment provided in the cooling compartment to form a predetermined cooling space, a cool air generation compartment having a cooler and a fan to supply cool air, and a partition plate that partitions a predetermined space into the cooling compartment and the cool air generation compartment. The partition plate includes a main path to guide the cool air into the cooling compartment and a bypass path to guide the cool air into the storage compartment. A cool air controller is provided at the bypass path to control the cool air supplied to the storage compartment via the bypass path.

20 Claims, 4 Drawing Sheets

(56) References Cited

U.S. PATENT DOCUMENTS

| | | | | | |
|---|---|---|---|---|---|
| 3,305,164 | A | * | 2/1967 | Laing | 417/350 |
| 3,375,677 | A | * | 4/1968 | Bright et al. | 62/89 |
| 3,745,786 | A | * | 7/1973 | Laughlin et al. | 62/419 |
| 4,296,611 | A | * | 10/1981 | Griffin et al. | 62/89 |
| 4,704,874 | A | * | 11/1987 | Thompson et al. | 62/187 |
| 5,209,073 | A | * | 5/1993 | Thomas et al. | 62/81 |
| 5,460,010 | A | * | 10/1995 | Kobayashi et al. | 62/187 |
| 5,778,694 | A | * | 7/1998 | Jeong | 62/187 |
| 5,784,895 | A | * | 7/1998 | Choi | 62/407 |
| 5,822,998 | A | * | 10/1998 | Lim et al. | 62/186 |
| 5,983,654 | A | * | 11/1999 | Yamamoto et al. | 62/187 |
| 6,539,729 | B2 | * | 4/2003 | Tupis et al. | 62/89 |
| 6,629,429 | B1 | * | 10/2003 | Kawamura et al. | 62/441 |
| 2004/0007007 | A1 | * | 1/2004 | Petesch et al. | 62/244 |
| 2006/0005568 | A1 | * | 1/2006 | Sim et al. | 62/419 |
| 2006/0032264 | A1 | * | 2/2006 | Shim | 62/408 |

FOREIGN PATENT DOCUMENTS

| | | | | | |
|---|---|---|---|---|---|
| JP | 11-270956 | A | | 10/1999 | |
| JP | 2002-031466 | | | 1/2002 | |
| JP | 2002364894 | | * | 12/2002 | F24F 7/007 |
| JP | 2004232955 | | * | 8/2004 | F25D 17/08 |
| KR | 10-2007-0025330 | A | | 10/1999 | |
| KR | 10-2003-0043223 | A | | 6/2003 | |
| KR | 2006-0018724 | | | 3/2006 | |
| KR | 20060018724 | | * | 3/2006 | F25D 17/06 |
| KR | 1020060018724 | | * | 3/2006 | F25D 17/06 |
| WO | WO 2006/064601 | | | 6/2006 | |
| WO | WO 2008/120927 | | | 10/2008 | |

OTHER PUBLICATIONS

PCT International Search Report dated Jan. 12, 2009.
International Search Report dated Jan. 12, 2009.

* cited by examiner

REFRIGERATOR AND A CONTROL METHOD FOR THE SAME

TECHNICAL FIELD

The present invention relates to a refrigerator and a control method for the same. More particularly, the present invention relates to a refrigerator and a control method to control at least one refrigerator compartment or storage compartment provided therein.

BACKGROUND ART

Refrigerators are typically home appliances to preserve food stuffs in cooling compartments such as refrigerator compartments and freezer compartments by means of cool air generated by a freezing cycle unit configured of compressors and heat exchangers.

Such the refrigerator has a storage compartment, called as special compartment, additionally provided in the cooling compartment and the storage compartment is controlled independently, having a cooling system with a wide temperature range based on properties of cooling objects and an optimal cooling condition to preserve properties of cooling objects as long as possible.

DISCLOSURE OF INVENTION

Technical Problem

However, to control the cooling compartment and the storage compartment independently, an auxiliary evaporator and an auxiliary unit for controlling cool air are necessary. As a result, production cost might rise and the control method for such conventional refrigerator might be complicated.

In addition, instead of the auxiliary evaporator, an evaporator for controlling the cooling compartment may be employed for independent control. However, in this case, several complicated units are necessary, which results in high production cost and a complex control method.

Technical Solution

Accordingly, the present invention is directed to a refrigerator and a control method for the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body comprising a cooling compartment and a storage compartment provided in the cooling compartment to form a predetermined cooling space; a cool air generation compartment comprising a cooler and a fan to supply cool air; a partition plate to partition a predetermined space into the cooling compartment and the cool air generation compartment, the partition plate comprising a main path to guide the cool air into the cooling compartment and a bypass path to guide the cool air into the storage compartment; and a cool air control unit provided at the bypass path to control the cool air supplied to the storage compartment via the bypass path.

The refrigerator may further include a guiding part having a fan, the guiding part in communication with the main path and the bypass path to guide the cool air supplied by the fan into the main path or the bypass path.

The bypass path includes a bypass guiding part in communication with the guiding part to guide the cool air from the guiding part to the storage compartment; and a cool air hole to communicate the bypass guiding part with the storage compartment.

The refrigerator may further include a damper to control the supply of the cool air to the cooling compartment by opening and closing the main path.

The cool air control unit may include a closable member to selectively open and close the bypass path.

The cool air control unit may include a cool air induction fan to induce the cool air from the bypass path such that the supply of the cool air to the storage compartment is substantially accelerated.

The cool air control unit may include a closable member to selectively open and close the bypass path; and a cool air induction fan to induce the cool air from the bypass path such that the supply of the cool air to the storage compartment is substantially accelerated.

In another aspect, a control method for a refrigerator includes (A) of determining an operational mode; (B) of sensing at least one of temperatures of a cooling compartment and a storage compartment according to the operational mode determined in (A); (C) of determining whether the temperature sensed in (B) is higher than a preset temperature; and (D) of controlling a cooler, a fan, a damper and a cool air control unit based on the result of (C).

(A) may include a cooling compartment operational mode to control the cool air supply to the cooling compartment; a storage compartment operational mode to control the cool air supply to the storage compartment; and a simultaneous operational mode to control the cool air supply to the cooling compartment and the storage compartment.

If the cooling compartment operational mode is selected in (A) and the temperature of the cooling compartment is over a first preset temperature in (C), (D) may include operating the cooler; opening the damper; making the cool air control unit close a bypass path; and operating the fan.

If the storage compartment operational mode is selected in (A) and the temperature of the storage compartment is over a second preset temperature in (C), (D) may include operating the cooler; closing the damper; inducing the cool air into the bypass path by making the cool air control unit open a bypass path in order; and operating the fan.

If the simultaneous operational mode is selected in (A) and the temperature of the cooling compartment is over a first preset temperature and the temperature of the storage compartment is over a second preset temperature in (C), (D) may include operating the cooler; opening the damper; inducing the cool air into the bypass path by making the cool air control unit open the bypass path; and operating the fan.

If the simultaneous operational mode is selected in (A) and the temperature of the cooling compartment is over a first preset temperature and the temperature of the storage compartment is below a second preset temperature in (C), (D) may include operating the cooler; opening the damper; making the cool air control unit close a bypass path; and operating the fan.

If the simultaneous operational mode is selected in (A) and the temperature of the cooling compartment is below a first preset temperature and the temperature of the storage compartment is over a second preset temperature in (C), (D) may include operating the cooler; closing the damper; inducing the cool air into a bypass path by making the cool air control unit open a bypass path; and operating the fan.

In a still further aspect, a control method for a refrigerator comprising a cooling compartment, a storage compartment provided in the cooling compartment separately, a main path to guide cool air into the cooling compartment and a bypass path to guide the cool air into the storage compartment, the control method includes (A) of selecting one of a cooling compartment operational mode to supply the cool air to the cooling compartment, a storage operational mode to supply the cool air to the storage compartment and a simultaneous operational mode to supply the cool air to the cooling compartment and the storage compartment simultaneously; (B) of sensing a temperature inside at least one of the cooling compartment and the storage compartment according to the selected operational mode in (A); (C) of determining whether the temperature sensed in (B) is over a preset temperature; and (D) of supplying the cool air to at least one of the cooling compartment and the storage compartment of which temperature is over the preset temperature, if it is determined in (C) that the sensed temperature is over the preset temperature.

If the cooling compartment operational mode is selected in (A) and the temperature of the cooling compartment is over a first preset temperature in (C), (D) may include opening a damper provided at the main path to make the cool air drawn into the main path; closing a cool air control unit provided at a bypass path to prevent the cool air from being drawn into the bypass path.

If the storage compartment operational mode is selected in (A) and the temperature of the storage compartment is over a second preset temperature in (C), (D) may include opening the cool air control unit to make the cool air drawn into the bypass path; and closing a damper provided at the main path to prevent the cool air from being drawn into the main path.

If the simultaneous operational mode is selected in (A) and the temperature of the cooling compartment is over a first preset temperature and the temperature of the storage compartment is over a second preset temperature in (C), (D) may include opening a damper provided at the main path to make the cool air drawn into the main path; and opening a cool air control unit provided at the bypass path to make the cool air drawn into the bypass path.

If the simultaneous operational mode is selected in (A) and the temperature of the cooling compartment is over a first preset temperature and the temperature of the storage compartment is below a second preset temperature in (C), (D) may include closing a cool air control unit provided at the bypass path to prevent the cool air from being drawn into the bypass path; and opening a damper provided at the main path to make the cool air drawn into the main path.

If the simultaneous operational mode is selected in (A) and the temperature of the cooling compartment is below a first preset temperature and the temperature of the storage compartment is over a second preset temperature in (C), (D) may include closing a damper provided at the main path to prevent the cool air from being drawn into the main path; and opening a cool air control unit provided at the bypass path to make the cool air drawn into the bypass path.

It is to be understood that both the foregoing general description and the following detailed description of the present invention are exemplary and explanatory and are intended to provide further explanation of the invention as claimed.

Advantageous Effects

The refrigerator and the control method for the same with above configuration make it possible to adjust temperatures of the storage compartment that is operated independently from the operation of the cooling compartment, as well as to adjust temperatures of the cooling compartment. As a result, according to the embodiment, there is an effect of high refrigerator operation efficiency and high reliability of storage function for various kinds of cooling objects.

MODE FOR THE INVENTION

In reference to FIG. 1, a structure of a refrigerator according to the present invention will be described.

Figure 1:
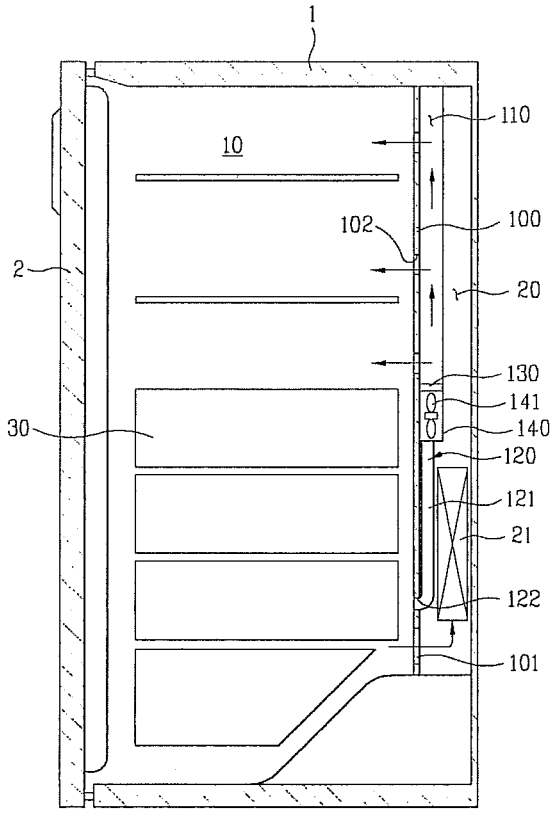
FIG. 1 is a diagram illustrating a side sectional view of a refrigerator according to an exemplary embodiment.

As shown in FIG. 1, the refrigerator includes a body 1, a cooling compartment 10 provided in the body 1, a cool air generation compartment 20 to supply cool air to the cooling compartment 10 and a partition plate 100 to partition a space into the cooling compartment 10 and the cool sir generation compartment 20.

In the cooling compartment 10 may be provided a storage compartment 30 in which cooling is performed independently. The storage compartment 30 is for quick-freezing cooling objects provided therein or to preserve cooling objects for relatively long time at predetermined temperatures.

The cooling compartment 10 may be a freezer compartment to freeze the cooling objects or a refrigerator compartment to refrigerate the cooling objects.

The storage compartment 30 may be embodied as a storage space in which a temperature range is kept regularly and the temperature range is different from that of the freezer compartment or the refrigerator compartment. Thus, the storage compartment 30 may have temperatures that are lower than those of the refrigerator compartment or higher than those of the freezer compartment or the storage compartment may have temperatures that are lower than those of the refrigerator compartment.

In any cases, the temperatures should be lower than those of the refrigerator compartment in the storage compartment. As a result, it is preferable that the cooling compartment is configured as the refrigerator compartment, rather than the freezer compartment. That is, it is preferable that the cooling compartment is provided in the refrigerator compartment.

A cooler 21 is provided in the cool air generation compartment 20 to generate cool air and the cooler 21 may be presented as an evaporator connected with predetermined units configured of the freezing cycle, or as a thermoelectric element.

The cooling compartment 10 and the cool air generation compartment 20 are partitioned by the partition plate 100 and the partition plate 100 includes a path of cool air to supply the cool air generated in the cooler 21 to the cooling compartment 10 and the storage compartment 30. In addition, a fan 141 is installed at the partition plate 100.

The cool air generated at the cooler 21 is sent by the fan 141 and the cool air is supplied to the cooling compartment 10 or the storage compartment 30 via at least one of a path in communication with the cooling compartment 10 and a path in communication with the storage compartment 30.

Here, the path in communication with the cooling compartment 10 may be a main path 110 and the path in communication with the storage compartment 30 may be a bypass path 120.

Ends of the storage compartment 30 and the bypass path 120 are spaced apart each other, and a communication hole (not shown) is formed at the storage compartment 30 in a predetermined size so that the cool air supplied via the bypass path 120 may be drawn into the storage compartment 30 through the communication hole (not shown).

Also, the cool air supplied via the bypass path 120 may cool containers inside the storage compartment 30 to cool the cooling objects inside the storage compartment 30.

As shown in FIG. 1, it is preferable that the bypass path 120 is connected with the storage compartment 30 so that the cool air flowing along the bypass path 120 may be drawn into the storage compartment 30 directly.

An outlet 102 is formed at the partition plate 100 so that the cool air is exhausted into the cooling compartment 10 and an inlet 101 is formed at the partition plate 100 so that the exhausted air into the cooling compartment 10 may be drawn into the cool air generation compartment 20 again.

A damper 130 is provided at the main path 110 to prevent the cool air ventilated from the fan 141 from being drawn into the main path 110.

Specifically, the damper 130 is opened according to an operational mode of the refrigerator to allow the cool air to flow and the damper 130 is closed to prevent the cool air from being drawn into the main path 110.

In addition, a cool air control unit 150 is installed at the bypass path 120 and the cool air control unit 150 controls the cool air ventilated by the fan 141 to flow to the bypass path 120.

That is, the bypass path 120 is closed according to an operational mode of the refrigerator to prevent the cool air from flowing to the bypass path 120 and the bypass path 120 is opened to allow the cool air ventilated by the fan 141 to flow to the bypass path 120 so that the cool air may be supplied to the storage compartment 30.

The bypass path 120 includes a bypass guiding part 121 that guides the cool air toward the storage compartment 30 and a cool air hole 122 that makes the bypass guiding part 121 in communication with the storage compartment 30.

In reference to FIG. 2, the refrigerator according to the embodiment will be described in detail.

Figure 2:
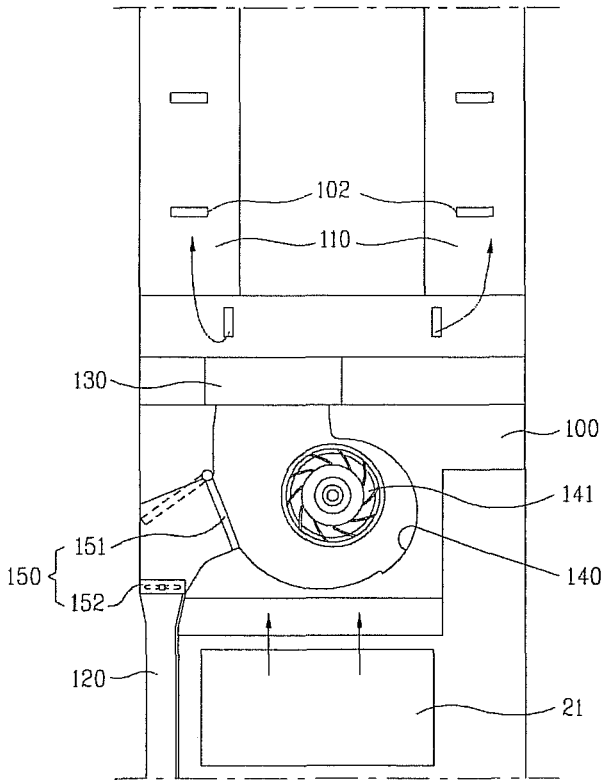
FIG. 2 is a diagram illustrating key parts of the refrigerator according to the embodiment.

As shown in FIG. 2, the fan 141 is provided at the partition plate 100 to suck and ventilate the cool it generated by the cooler 21 and a guiding part 140 is provided at the partition plate 100 to guide the cool air sucked by the fan 141 to the main path 110 and/or the bypass path 120.

It is preferable that the fan 141 is a centrifugal fan. That is, the cool air is sucked in a shaft direction of the fan 141 and ventilated in a circumferential direction.

The guiding part 140 is in communication with the bypass path 120 such that the cool air flowing by the fan 141 is guided by the guiding part 140 to be sent to the main path 110 or the bypass path 120.

The guiding part 140 is recessed to a predetermined thickness and its circumferential surface forms a curvature.

That is, as shown in FIG. 2, a predetermined portion of the guiding part 140 is curved to be adjacent to the fan 140 and the curvature is spaced apart from the fan 141 a predetermined distance to be connected with the bypass path 120 and the main path 110.

On the other hand, the damper 130 is provided between the guiding part 140 and the main path 110 and the cool air control unit 150 is provided on the bypass path 120.

The cool air control unit 150 is configured to open and close the bypass path 120, more specifically, the bypass guiding part 121 such that the cool air is bypassed from the guiding part 140 when the bypass path 120 is opened.

FIG. 2 presents a closable member 151 and a cool air induction fan 152 as an example of the cool air control unit 150.

However, the cool air control unit 150 is not limited to what is shown in FIG. 2 and it may be configured to be a closable member 151 or a cool air induction fan 152.

If the closable member 151 is provided as the cool air control unit 150, the openness of the closable member 151, which is an opening degree of the bypass guiding part 121, is adjusted to adjust the amount of the bypassed cool air.

If only the cool air induction fan 152 is provided as the cool air control unit 150, the cool air induction fan 152 stands in the bypass guiding part 121 and the amount of the cool air supplied to the storage compartment 30 after being guided to the bypass guiding part 121 is not so much (this is because the cool air induction fan 152 is operated by resist of cool air flow). If the cool air does not have to be supplied to the storage compartment intensively, the cool air induction fan 152 is operated to induce the cool air from the guiding part 140 and to send the cool air to the storage compartment 30.

In reference to FIGS. 1 and 2, an operation of the refrigerator according to the present invention will be explained and in reference to FIGS. 3 and 4, a control method of the refrigerator according to the present invention will be explained together.

Operational modes of the refrigerator are configured of a cooling compartment operation mode and a storage compartment operation and a simultaneous operation mode.

In the cooling compartment operation mode, the supply of the cool air is controlled to adjust temperatures and the control of cool air supply to the storage compartment 30 is turned off. In the storage compartment operation mode, the cool air supply to the storage compartment 30 is controlled to adjust temperatures and the control of cool air supply to the cooling 10 is turned off.

In the simultaneous operation mode, the cool air supply to the cooling compartment 10 and the storage compartment 30 is controlled.

Although not described in FIGS. 1 and 2, the refrigerator according to the embodiment includes a controller (not shown) that receives temperature information from temperature sensors (not shown) installed at the cooling compartment 10 and the storage compartment 30 that are provided in the cooling compartment 10 and the storage compartment 30, respectively. The controller controls the cooler 21, if the cooler 21 is operated as a freezer cycle unit, a compressor is controlled, the fan 141, the damper 130 and the cool air control unit 150.

First, the controller determines which operation mode the present operation mode is. That is, a user selects an operational mode or an operational mode is determined automatically by a value of a temperature received by the temperature sensor (S100, S200 and S300).

If the cooling compartment operation mode is determined (S100), the temperature sensor installed at the cooling compartment 10 senses the temperature (TR) of the cooling compartment 10 to transmit the sensed temperature value to the controller (S110).

The controller compares the sensed temperature TR of the cooling compartment 10 with a first preset temperature Ts1 to determine whether TR exceeds Ts1 (S120).

Here, the first preset temperature TS1 is predetermined and it is the highest temperature that should be maintained. Such that first preset temperature TS1 may be predetermined by a manufacturer when releasing the product or a user may select and predetermine the first preset temperature.

As a result, the cool air should be controlled for the temperature of the cooling compartment 10 to be below the first preset temperature TS1.

If the temperature TR of the cooling compartment 10 is over the first present temperature Ts1 in the step of S120, the controller operates the cooler (S121) and opens the damper 130 to open the main path 110 (S122). As a result, the closable member 151 of the cool air control unit is closed to close the bypass path 120.

Hence, the cool air induction fan 152 is turned off (S124) and the fan 141 is operated (S125) to suck and discharge the cool air generated from the cooler 21. At this time, the cool air is guided by the guiding part 140 to flow along the main path 110 and then it is discharged to the cooling compartment 10 via the outlet 102.

The cool air discharged to the cooling compartment 10 cools each portion of the cooling compartment 10 and it is sent to the cool air generation compartment 20 again.

If the temperature TR inside the cooling compartment is below the first preset temperature Ts1, the cooler does not have to be operated, only to turn off the cooler 21 and the fan 141 (S126).

In the meantime, if the controller determines the storage compartment operational mode (S200), the temperature sensor (not shown) installed at the storage compartment 30 senses the temperature Tr of the storage compartment 30 and sends the value of the temperature to the controller (S210).

The controller compares the sensed temperature Tr of the storage compartment with a second preset temperature Ts2 to determine whether Tr is over Ts2 (S220).

Here, the second preset temperature Ts2 is preset as the highest temperature that should be maintained in the storage compartment 30. Such that second preset temperature Ts2 may be predetermined by a manufacturer in a release process of the product, or a user selects predetermine the second preset temperature Ts2.

As a result, the cool air should be controlled for the temperature of the storage compartment 30 to be below the second preset temperature TS2. It is possible to determine the temperatures of the storage compartment 30 as a predetermined temperature range to maintain within the predetermined temperature range. If the temperature of the storage compartment 30 is over the second preset temperature Ts2, the controller operates the cooler 21 (S221) and closes the damper 130 to close the main path 110 (S222). The closable member 151 is opened to open the bypass path 120. Hence, the fan 141 is operated (S224) and the cool air induction fan 152 is operated (S225). The cool air ventilated by the fan 141 according to the above control passes the bypass path 120, not the main path 110, and it is supplied to the storage compartment 30 via the cool air hole 122 along the bypass guising part 121.

If the temperature Tr of the storage compartment 30 is below the second preset temperature Ts2, the cooler 21, the fan 41 and the cool air induction fan 152 are all turned of (S231).

In case that the controller determines to operate the simultaneous operational mode (S300), the controller receives the temperature information from the temperature sensors installed at the cooling compartment 10 and the storage compartment 30, respectively.

That is, each of the temperature sensors installed at the cooling compartment 10 and the storage compartment 30 senses the temperature (S310).

The controller compares the temperature TR of the cooling compartment and the temperature Tr of the storage compartment with the first preset temperature Ts1 and the second preset temperature Ts2 (S320, S330 and S360), respectively.

The controller determines the temperature TR of the cooling compartment is over the first preset temperature Ts1 (S320).

Figure 3:
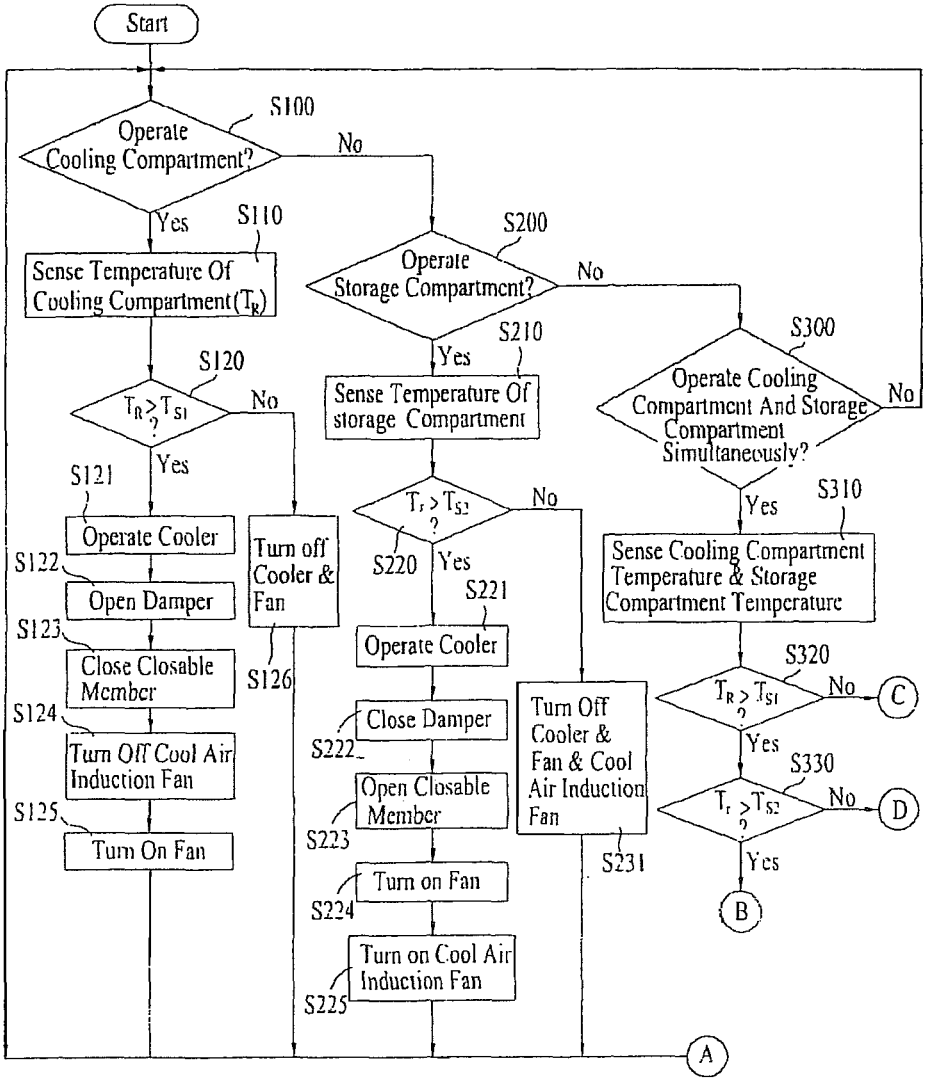
FIGS. 3 and 4 are a flow chart illustrating a control method of the refrigerator.
Figure 4:
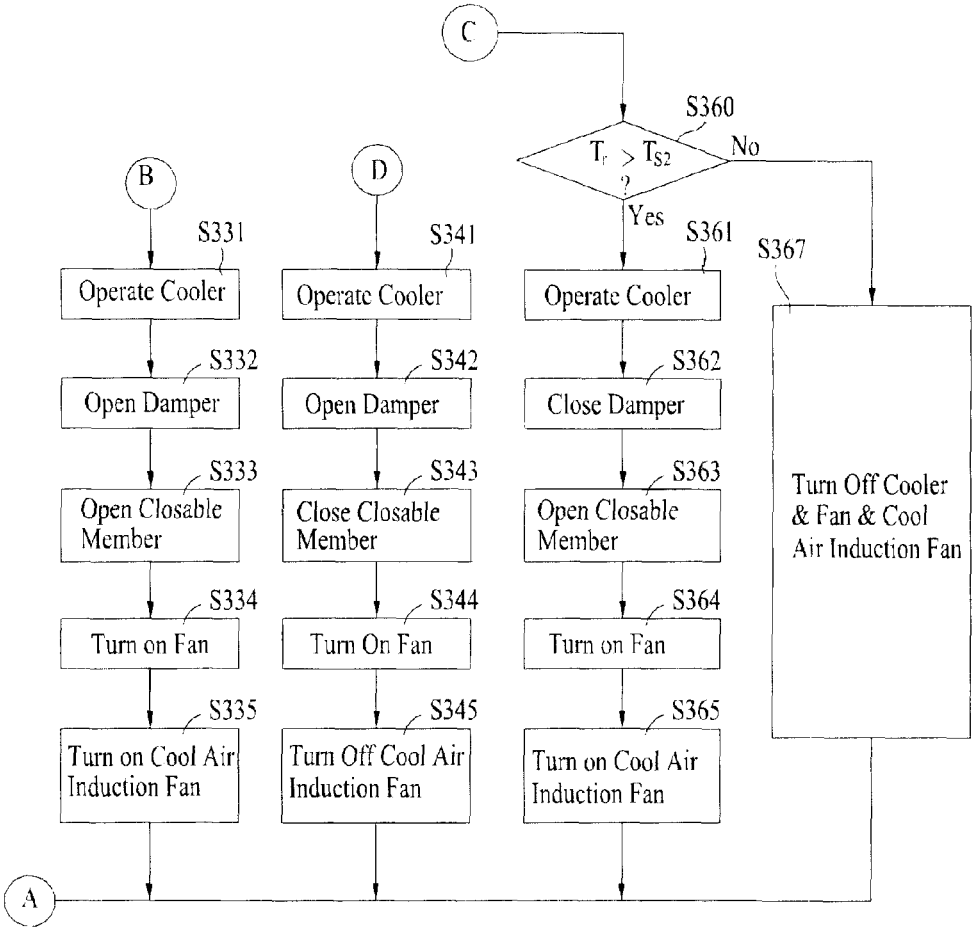

A control method of a refrigerator according to the exemplary embodiment as shown in FIGS. 3 and 4 present four control methods in the simultaneous operational mode.

That is, if TR is over Ts1 with respect to the step S320, a case of Tr of the storage compartment over the second preset temperature Ts2 and an opposite case are presented. If the result of S320 is that TR is below Ts1, a case of the temperature Tr of the storage compartment 30 is over the second preset temperature Ts2 and an opposite case are presented. As a result, total four control methods are presented.

The four control methods are (□) TR>Ts1, Tr>Ts2, (□) TR>Ts1, Tr≤Ts2, (□) TR≤Ts1, Tr>Ts2, and (□) TR≤Ts2, Tr≤Ts2 and the control is performed in those cases.

First, in case of TR>Ts1, Tr>Ts2, the controller operates the cooler 21 (S331) and opens the damper 130 to open the main path 110 (S332). Next, the controller opens the closable member 151 to open the bypass path 120 (S333) and operates the fan 141 (S334) and operates the cool air induction fan 152 (S335).

The cool air ventilated by the fan 141 is guided by the guiding part 140 to pass the main path 110 and the bypass path 120 through the above control. As a result, the cool air is supplied to the cooling compartment 10 and the storage compartment 30, respectively.

In case of TR>Ts1, Tr≤Ts2, the controller operates the cooler 21 (S341) and opens the damper 130 to open the main path 110 (S342) and then it closes the closable member 151 to close the bypass path (S343).

Next, the controller operates the fan 141 (S344) and it turns of the cool air induction fan 152.

As a result, through this control the cool air ventilated by the fan 141 is guided by the guiding part 140 to pas the main path 110. As a result, the cool air is supplied to the cooling compartment 10 and not to the storage compartment 30.

In case of TR≤Ts1, Tr>Ts2, the controller operates the cooler 21 (S361) and closes the damper 130 to close the main path 110 (S362). The controller opens the closable member 151 to open the bypass path 120 (S363).

Next, the controller operates the fan 141 (S364) and operates the cool air induction fan 152 (S365).

Through this control, the cool air ventilated by the fan 141 is guided by the guiding part 140 to pass the bypass path 120. As a result, the cool air is supplied to the storage compartment 30 and not to the cooling compartment 10.

In case of TR≤Ts1, Tr≤Ts2, both the cooling compartment and the storage compartment have appropriate temperatures, respectively. Thus, the cooler 21, the fan 141 and the cool air induction fan 152 are turned off (S367).

The invention claimed is:

1. A refrigerator, comprising:

a body comprising a cooling compartment and a storage compartment provided in the cooling compartment to form a predetermined cooling space;

a cool air generation compartment comprising a cooler that supplies cool air, wherein the cool air generation compartment is provided behind the cooling compartment and the cooler is provided in the cool air generation compartment;

a partition plate that partitions a predetermined space into the cooling compartment and the cool air generation compartment, the partition plate comprising a main path that guides the cool air into the cooling compartment and a bypass path that guides the cool air to the storage compartment;

a damper that controls the supply of the cool air to the cooling compartment by opening and closing the main path;

a cool air control unit provided at the bypass path that controls the cool air supplied to the storage compartment via the bypass path, the cool air control unit comprising a closable member that selectively opens and closes the bypass path;

an induction fan provided at an entrance of the bypass path; and a guiding part having a centrifugal fan disposed therein, wherein a shaft of the centrifugal fan is horizontally mounted in the guiding part over the cooler, the cool air is sucked in a shaft direction of the centrifugal fan and ventilated in a circumferential direction by the centrifugal fan, wherein the guiding part has a scroll shape having a predetermined thickness and a curved circumferential surface spaced a predetermined distance apart from the centrifugal fan that connects with the main path and the bypass path, respectively, wherein the guiding part guides the cool air supplied by the centrifugal fan into the main path and the bypass path selectively, wherein the damper is provided in an entrance of the main path connected to an upper surface of guiding part, wherein the closable member is pivotably mounted in the entrance of the bypass path, the entrance of the bypass path being provided on a side surface of the guiding part, and wherein the closable member forms a substantially smooth inner side surface of the guiding part when the closable member is closed.

2. The refrigerator as claimed in claim 1, wherein the bypass path comprises:

a bypass path guiding part in communication with the guiding part, that guides the cool air from the guiding part to the storage compartment; and a cool air hole by which the bypass path guiding part communicates with the storage compartment.

3. The refrigerator as claimed in claim 1, wherein the cool air induction fan is configured to induce the cool air from the bypass path such that the supply of the coot air to the storage compartment is substantially accelerated.

4. A control method for the refrigerator as claimed in claim 1, the method comprising:

selecting one of a cooling compartment operational mode to supply the cool air to the cooling compartment, a storage compartment operational mode to supply the cool air to the storage compartment, and a simultaneous operational mode to supply the cool air to the cooling compartment and the storage compartment simultaneously;

sensing a temperature inside at least one of the cooling compartment or the storage compartment based on the selected operational mode;

determining whether the sensed temperature is higher than a predetermined temperature; and supplying the cool air to at least one of the cooling compartment or the storage compartment for which the sensed temperature is higher than the predetermined temperature, if the sensed temperature is higher than the predetermined temperature.

5. The control method of claim 4, wherein if the cooling compartment operational mode is selected and if the sensed temperature of the cooling compartment is higher than a first predetermined temperature, the supplying the cool air comprises:

opening the damper provided at the main path so that the cool air is drawn into the main path;

closing the bypass path using the cool air control unit provided at the bypass path to prevent the cool air from being drawn into the bypass path.

6. The control method as claimed in claim 4, wherein if the storage compartment operational mode is selected and if the sensed temperature of the storage compartment is higher than a second predetermined temperature, the supplying the cool air comprises:

opening the bypass path using the cool air control unit so that the cool air is drawn into the bypass path; and closing the damper provided at the main path to prevent the cool air from being drawn into the main path.

7. The control method as claimed in claim 4, wherein if the simultaneous operational mode is selected, and the sensed temperature of the cooling compartment is higher than a first predetermined temperature and the sensed temperature of the storage compartment is higher than a second predetermined temperature, the supplying the cool air comprises:

opening the damper provided at the main path so that the cool air is drawn into the main path; and opening the bypass path using the cool air control unit provided at the bypass path so that the cool air is drawn into the bypass path.

8. The control method as claimed in claim 4, wherein if the simultaneous operational mode is selected, and the sensed temperature of the cooling compartment is higher than a first predetermined temperature and the sensed temperature of the storage compartment is lower than a second predetermined temperature, the supplying the cool it comprises:

closing the bypass path using the cool air control unit provided at the bypass path to prevent the cool air from being drawn into the bypass path; and opening the damper provided at the main path so that the cool air is drawn into the main path.

9. The control method as claimed in claim 4, wherein if the simultaneous operational mode is selected, and the sensed temperature of the cooling compartment is lower that a first predetermined temperature and the sensed temperature of the storage compartment is higher than a second predetermined temperature, the supplying the cool air comprises:

closing the damper provided at the main path to prevent the cool air from being drawn into the main path; and opening the bypass path using the cool air control unit provided at the bypass path so that the cool air is drawn into the bypass path.

10. The refrigerator as claimed in claim 1, wherein the centrifugal fan sucks the cool air in a direction that a shaft thereof extends and ventilates the sucked cool air in a circumferential direction thereof.

11. The refrigerator as claimed in claim 1, wherein the refrigerator comprises only one fan in the cool air generation compartment, the fan supplying cool air to both the cool air generation compartment and the storage compartment.

12. The refrigerator as claimed in claim 1, wherein the main path extends upward from the guiding part and the bypass path extends downward from the guiding part.

13. The refrigerator as claimed in claim 1, wherein when the closable member is closed, cool air is not supplied to the bypass path.

14. A control method for the refrigerator as claimed in claim 1, the method comprising:

determining an operational mode;

sensing at least one of temperatures of the cooling compartment or the storage compartment based on the determined operational mode;

determining whether the sensed temperature is higher than a predetermined temperature; and controlling the cooler, the centrifugal fan, the damper, and the cool air control unit based on a result of the determining whether the sensed temperature is higher than the predetermined temperature.

15. The control method as claimed in claim 14, wherein the determining of the operational mode comprises determining one of the following operational modes:

a cooling compartment operational mode to control the cool air supply to the cooling compartment;

a storage compartment operational mode to control the cool air supply to the storage compartment; and a simultaneous operational mode to control the cool air to be supplied to the cooling compartment and the storage compartment simultaneously.

16. The control method as claimed in claim 15, wherein if the determined operational mode is the cooling compartment operational mode, and if the sensed temperature of the cooling compartment is higher than a first predetermined temperature, the controlling comprises:

operating the cooler;

opening the damper;

closing the bypass path using the cool air control unit; and

Operating the centrifugal fan.

17. The control method as claimed in claim 15, wherein if the determined operational mode is the storage compartment operational mode, and if the sensed temperature of the storage compartment is higher than a second predetermined temperature, the controlling comprises:

operating the cooler;

closing the damper;

inducing the cool air into the bypass path by opening the bypass path using the cool air control unit; and operating the centrifugal fan.

18. The control method as claimed in claim 15, wherein if the determined operational mode is the simultaneous operational mode, and if the sensed temperature of the cooling compartment is higher than a first predetermined temperature and the sensed temperature of the storage compartment is higher than a second predetermined temperature, the controlling comprises:

operating the cooler;

opening the damper;

inducing the cool air into the bypass path by opening the bypass path using the cool air control unit; and operating the centrifugal fan.

19. The control method as claimed in claim 15, wherein if the determined mode is the simultaneous operational mode, and if the sensed temperature of the cooling compartment is higher than a first predetermined temperature and the sensed temperature of the storage compartment is lower than a second predetermined temperature, the controlling comprises:

operating the cooler;

opening the damper;

closing the bypass path using the cool air control unit; and operating the centrifugal fan.

20. The control method as claimed in claim 15, wherein if the determined operational mode is the simultaneous operational mode, and if the sensed temperature of the cooling compartment is lower than a first predetermined temperature and the sensed temperature of the storage compartment is higher than a second predetermined temperature, the controlling comprises, operating the cooler;

closing the damper;

inducing the cool air into a bypass path by opening the bypass path using the cool air control unit; and operating the centrifugal fan.

* * * * *